US009732455B2

(12) United States Patent
Goenka

(10) Patent No.: US 9,732,455 B2
(45) Date of Patent: Aug. 15, 2017

(54) NATURAL FINISH FABRIC

(71) Applicant: WELSPUN INDIA LIMITED, Mumbai (IN)

(72) Inventor: Dipali Goenka, Mumbai (IN)

(73) Assignee: WELSPUN INDIA LIMITED, Mumbai (IN)

( * ) Notice: Subject to any disclaimer, the term of this patent is extended or adjusted under 35 U.S.C. 154(b) by 375 days.

(21) Appl. No.: 14/631,700

(22) Filed: Feb. 25, 2015

(65) Prior Publication Data

US 2015/0259843 A1 Sep. 17, 2015

(30) Foreign Application Priority Data

Mar. 11, 2014 (IN) ..... 808/MUM/2014

(51) Int. Cl.

| | |
|---|---|
| ***D06C 27/00*** | (2006.01) |
| ***D06C 9/00*** | (2006.01) |
| ***D06C 11/00*** | (2006.01) |
| ***D06B 21/00*** | (2006.01) |
| ***D06C 9/02*** | (2006.01) |

(52) U.S. Cl.

CPC ..... *D06C 27/00* (2013.01); *D06B 21/00* (2013.01); *D06C 9/02* (2013.01); *D06C 11/00* (2013.01); *D10B 2201/02* (2013.01)

(58) Field of Classification Search

CPC . D06C 27/00; D06C 9/00; D06C 9/02; D06C 9/04; D06C 11/00; D06C 15/00; D06C 15/04; D06C 15/06; D06C 21/00; D06C 21/005; D06C 29/00; D06C 3/00; D06C 2700/02; D06C 2700/15; D06C 2700/16; D06B 21/00; D06B 1/00; D06B 2700/00

USPC ..... 26/3, 18.5, 18.6, 29 R; 28/165, 167

See application file for complete search history.

(56) References Cited

U.S. PATENT DOCUMENTS

| | | | | | |
|---|---|---|---|---|---|
| 3,290,752 | A * | 12/1966 | Ormand | A41C 5/00 | 28/156 |
| 3,403,433 | A * | 10/1968 | Schoeneberg | D06M 11/38 | 26/19 |
| 4,316,928 | A * | 2/1982 | Otto | B24B 19/223 | 26/28 |
| 4,624,675 | A * | 11/1986 | Irmer | D03D 27/00 | 428/85 |
| 4,712,290 | A * | 12/1987 | Lindsey | D06M 16/003 | 106/212.1 |
| 5,815,868 | A * | 10/1998 | Lee | D04B 1/18 | 68/13 R |
| 2010/0300576 | A1* | 12/2010 | Liu | D02G 3/04 | 139/35 |
| 2014/0259456 | A1* | 9/2014 | Harris | D06P 5/001 | 8/445 |

(Continued)

*Primary Examiner* — Amy Vanatta

(74) *Attorney, Agent, or Firm* — Tillman Wright, PLLC; Chad D. Tillman; Jeremy C. Doerre

(57) ABSTRACT

A method for producing environmentally friendly fabric and textile products without use of chemicals comprises a finishing process including the steps of: singeing, enzyme desizing; water washing, peaching, stentering, and sanforizing. The steps of the finishing process are purely physical and preferably uses only water, water vapor (steam), and enzymes, and not chemicals including chemical agents. As such, the finishing process is believed to be environmentally friendly.

20 Claims, 1 Drawing Sheet

(56) References Cited

U.S. PATENT DOCUMENTS

2014/0308865 A1* 10/2014 Kumar ..... D03D 15/0027
442/184

* cited by examiner

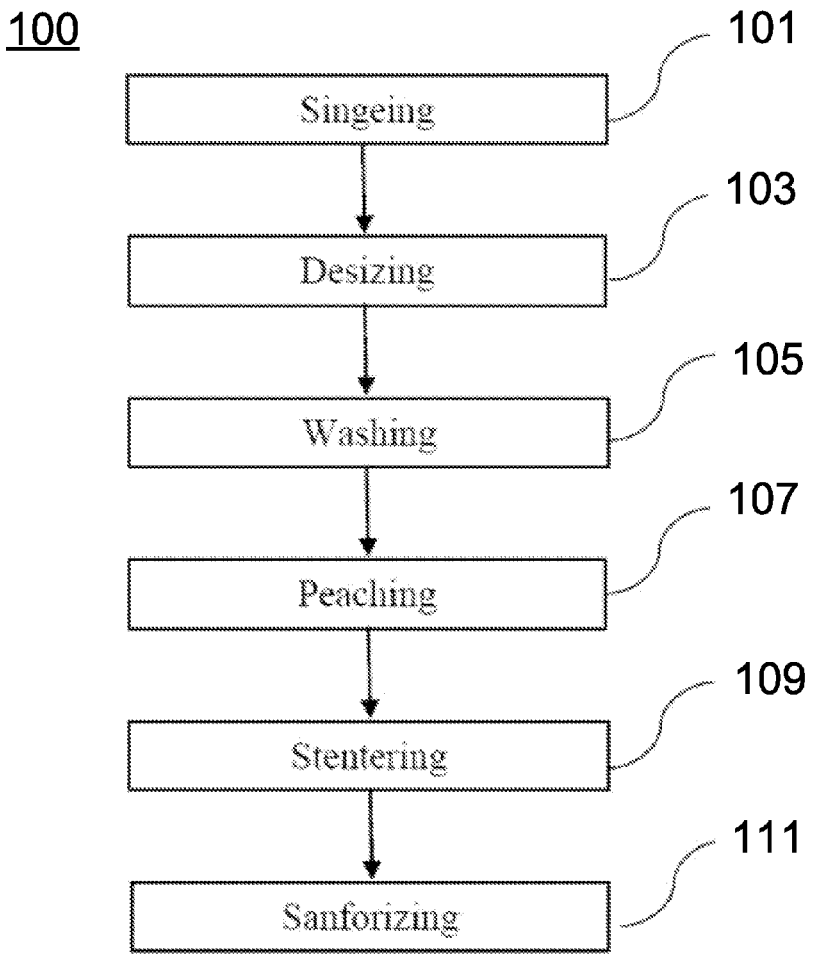
100
101
Singeing
103
Desizing
105
Washing
107
Peaching
109
Stentering
111
Sanforizing

NATURAL FINISH FABRIC

CROSS-REFERENCE TO RELATED APPLICATION

The present application claims foreign priority under 35 U.S.C. 119 to patent application 808/MUM/2014, filed in India on Mar. 11, 2014, which patent application is incorporated herein by reference.

COPYRIGHT STATEMENT

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

FIELD OF THE INVENTION

The present invention generally relates to a method for producing an environmentally friendly fabric and more particularly, but not exclusively, to a method of producing environmentally friendly fabric and textile products made therefrom without using any chemicals.

BACKGROUND OF THE INVENTION

The textile industry is an industry that, when compared to other industries, generally consumes the most water, air, chemical agents and power. Various processes are applied to textile products from first processing of the raw materials to arriving at the finished product. In such processes various chemicals and dyeing agents are applied to the textile goods under different conditions, particularly at finishing operations, so as to meet customer requirements regarding color, gluing, etc. Unfortunately, it is believed that the chemicals and dyeing agents used can be hazardous to the environment. The fabrication process should not harm the environment.

Furthermore, textile products are treated with various base and acid agents during finishing processes, and the acid and acidic residual remaining on the textile products can irritate the skin. For that reason, the pH value of textile products should be the same as a normal pH value of human skin, e.g., pH 5.5. Also, depending on types of fiber, dermatitis may occur on the skin. In conventional dermatitis cases, the veins close to skin reddens and inflames. If not recovered in due time, the color of skin gets darker and deep scars may occur. Particularly, synthetic fibers cause dermatologic problems such as allergy etc. The clothes being close in contact with human body should not harm people in any way, either through skin contact, breathing or respiratory.

In view of the foregoing, it is believed that there is a need for a method for producing environmentally friendly fabrics without use of chemicals and dyeing agents that are hazardous to the environment, and that results in fabric that does not irritate the skin or is a factor in causing dermatitis or allergies. One or more embodiments of the invention are believed to address one or more such needs.

SUMMARY OF THE INVENTION

In an aspect of the invention, a method is provided for producing a fabric for textile products without the use of any chemicals.

Another aspect of the invention comprises a method for producing environmentally friendly fabrics without the use of any chemicals.

Another aspect of the invention comprises a fabric finishing process that uses only water, water vapor (steam), and enzymes, so as to prevent use of chemicals including chemical agents.

Another aspect of the invention comprises a fabric finishing process that reduces power consumption and water consumption.

Another aspect of the invention comprises a fabric finishing process including a method including the steps of passing a continuous length of the fabric through a singeing machine at a predetermined speed. Further, the method includes subjecting the fabric treated in the singeing machine to an enzymatic desizing. Further, the method includes washing the fabric obtained from the enzymatic desizing, and the method includes impacting at least one of the surfaces of the fabric with a plurality of bristles after washing. In addition, the method includes passing the fabric impacted with the bristles to a stenter machine, and the method includes transferring the fabric obtained from the stenter machine to a sanforizing machine.

In a feature, the steps use only water, water vapor (steam), and enzymes, so as to prevent use of chemicals including chemical agents Another aspect of the invention comprises a fabric finishing process including a method for producing a fabric comprises the steps of passing a continuous length of fabric of a predetermined width on a singeing machine at a predetermined speed; subjecting the fabric treated with the singeing machine to an enzymatic desizing; washing the fabric obtained from the enzymatic desizing; impacting at least one of the surfaces of the fabric with a plurality of bristles; passing the fabric treated by the bristles to a stenter machine; and transferring the fabric obtained from the stenter machine to a sanforizing machine; wherein the steps are performed without use of chemicals.

In a feature, the finishing process uses only water, water vapor (steam), and enzymes, so as to prevent use of chemicals including chemical agents In a feature, the fabric in the singing machine is subjected to a gas singe having a flame temperature about 800° C. to 1000° C. and operating at a speed of 80 meters per minute to 100 meters per minute.

In a feature, the enzymatic desizing takes place in a desizing machine where enzymes are introduced at a temperature of 60° C. to 80° C. to react with the fabric for about six to eight hours.

In a feature, the fabric is washed with water having a temperature of about 85° C. to 95° C. at a speed of about 50 meters per minute to 60 meters per minute.

In a feature, the bristles are ceramic crystal bristles provided on a rotating cylinder which contacts at least one of the fabric surfaces.

In a feature, the fabric is passed between a rubber sleeve and a heated rotating cylinder having a temperature of about 50° C. to 60° C.

In another aspect, a method for producing a fabric, comprising the steps of: (a) singeing a continuous length of a fabric; (b) after said step (a), desizing the continuous length of fabric; (c) after said step (b), washing the continuous length of fabric; (d) after said step (c), peaching the continuous length of fabric by impacting at least one of the surfaces of the fabric with a plurality of bristles; (e) after said step (d), stentering the continuous length of fabric; and (f) after said step (e), sanforizing the continuous length of fabric; (g) wherein said steps (a) through (f) are performed using only water, water vapor, and enzymes without use of chemicals.

In a feature, the finishing process uses only water, water vapor (steam), and enzymes, so as to prevent use of chemicals including chemical agents In a feature, said step (a) is performed by passing the fabric on a singeing machine at a predetermined speed.

The continuous length of fabric in the singing machine preferably is subjected to a gas singe having a flame temperature about 800° C. to 1000° C. and operating at a speed of 80 meters per minute to 100 meters per minute.

In a feature, said step (b) is performed using a desizing machine.

In a feature, said step (b) comprises enzymatic desizing and the enzymatic desizing takes place in a desizing machine where the enzymes are introduced at a temperature of 60° C. to 80° C. to react with the continuous length of fabric for about six to eight hours.

In a feature, the continuous length of fabric is washed with water having a temperature of about 85° C. to 95° C. at a speed of about 50 to 60 meters per minute.

In a feature, the plurality of bristles comprises a plurality of ceramic crystals.

In a feature, the bristles are ceramic crystal bristles provided on a rotating cylinder which contacts at least one of the continuous length of fabric surfaces. Preferably, the ceramic crystal bristles are diamond shaped.

In a feature, said step (e) is performed using a stenter machine. The stenter machine preferably facilitates controlling width of the continuous length of fabric throughout its length.

In a feature, said step (f) is performed using a sanforizing machine. The continuous length of fabric preferably is passed between a rubber sleeve and a heated rotating cylinder having a temperature of about 50° C. to 60° C.

A method for producing a fabric comprises the steps of: (a) singeing a continuous length of a fabric by passing the fabric on a singeing machine at a predetermined speed, wherein the continuous length of fabric in the singing machine is subjected to a gas singe having a flame temperature about 800° C. to 1000° C. and operating at a speed of 80 meters per minute to 100 meters per minute; (b) after said step (a), enzymatic desizing the continuous length of fabric, wherein the enzymatic desizing takes place in a desizing machine in which enzymes are introduced at a temperature of 60° C. to 80° C. to react with the continuous length of fabric for about six to eight hours; (c) after said step (b), washing the continuous length of fabric with water having a temperature of about 85° C. to 95° C. at a speed of about 50 to 60 meters per minute; (d) after said step (c), peaching the continuous length of fabric by impacting at least one of the surfaces of the fabric with a plurality of diamond shaped ceramic crystals provided on a rotating cylinder which contacts at least one of the continuous length of fabric surfaces; (e) after said step (d), stentering the continuous length of fabric using a stenter machine such that a generally uniform width of the continuous length of fabric is provided; and (f) after said step (e), sanforizing the continuous length of fabric using a sanforizing machine, wherein the continuous length of fabric is passed between a rubber sleeve and a heated rotating cylinder having a temperature of about 50° C. to 60° C.; (g) wherein said steps (a) through (f) are performed using only water, water vapor, and enzymes without use of chemicals.

These and other aspects and features of the invention are further disclosed and described below with reference to one or more preferred embodiments. It should be understood, however, that such following description, while indicating one or more preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

One or more preferred embodiments of the present invention now will be described in detail with reference to the accompanying one or more drawings.

FIG. 1 illustrates a flowchart of a method for producing environmentally friendly fabric using only water, water vapor (steam), and enzymes, so as to prevent use of chemicals including chemical agents, in accordance with a preferred embodiment of the present invention.

DETAILED DESCRIPTION

As a preliminary matter, it will readily be understood by one having ordinary skill in the relevant art ("Ordinary Artisan") that the present invention has broad utility and application. As should be understood, any embodiment may incorporate only one or a plurality of the above-disclosed aspects of the invention and may further incorporate only one or a plurality of the above-disclosed features. Furthermore, any embodiment discussed and identified as being "preferred" is considered to be part of a best mode contemplated for carrying out the present invention. Other embodiments also may be discussed for additional illustrative purposes in providing a full and enabling disclosure of the present invention. As should be understood, any embodiment may incorporate only one or a plurality of the above-disclosed aspects of the invention and may further incorporate only one or a plurality of the above-disclosed features. Moreover, many embodiments, such as adaptations, variations, modifications, and equivalent arrangements, will be implicitly disclosed by the embodiments described herein and fall within the scope of the present invention.

Accordingly, while the present invention is described herein in detail in relation to one or more embodiments, it is to be understood that this disclosure is illustrative and exemplary of the present invention, and is made merely for the purposes of providing a full and enabling disclosure of the present invention. The detailed disclosure herein of one or more embodiments is not intended, nor is to be construed, to limit the scope of patent protection afforded the present invention in any claim of a patent issuing here from, which scope is to be defined by the claims and the equivalents thereof. It is not intended that the scope of patent protection afforded the present invention be defined by reading into any claim a limitation found herein that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present invention.

Accordingly, it is intended that the scope of patent protection afforded the present invention is to be defined by the issued claim(s) rather than the description set forth herein.

Additionally, it is important to note that each term used herein refers to that which the Ordinary Artisan would understand such term to mean based on the contextual use of such term herein. To the extent that the meaning of a term used herein—as understood by the Ordinary Artisan based on the contextual use of such term—differs in any way from any particular dictionary definition of such term, it is intended that the meaning of the term as understood by the Ordinary Artisan should prevail.

Regarding applicability of 35 U.S.C. 112, subsection (f), no claim element is intended to be read in accordance with this statutory provision unless the explicit phrase "means for" or "step for" is actually used in such claim element, whereupon this statutory provision is intended to apply in the interpretation of such claim element.

Furthermore, it is important to note that, as used herein, "a" and "an" each generally denotes "at least one," but does not exclude a plurality unless the contextual use dictates otherwise. Thus, reference to "a picnic basket having an apple" describes "a picnic basket having at least one apple" as well as "a picnic basket having apples." In contrast, reference to "a picnic basket having a single apple" describes "a picnic basket having only one apple."

When used herein to join a list of items, "or" denotes "at least one of the items," but does not exclude a plurality of items of the list. Thus, reference to "a picnic basket having cheese or crackers" describes "a picnic basket having cheese without crackers", "a picnic basket having crackers without cheese", and "a picnic basket having both cheese and crackers." Finally, when used herein to join a list of items, "and" denotes "all of the items of the list." Thus, reference to "a picnic basket having cheese and crackers" describes "a picnic basket having cheese, wherein the picnic basket further has crackers," as well as describes "a picnic basket having crackers, wherein the picnic basket further has cheese."

Referring now to the one or more drawings, one or more preferred embodiments of the present invention are next described. The following description of one or more preferred embodiments is merely exemplary in nature and is in no way intended to limit the invention, its implementations, or uses.

Furthermore, it will be appreciated that the embodiments herein and the various features and advantages thereof are explained more fully with reference to the non-limiting preferred embodiment of FIG. 1 and following detailed description. Moreover, descriptions of well-known components and processing techniques are omitted so as to not unnecessarily obscure discussion and focus of such embodiments. The one or more examples set forth herein are intended merely to facilitate an understanding of one or more ways of implementing the present invention by those of skill in the art. Accordingly, the examples should not be construed as limiting the scope of the invention or claims.

It is believed that preferred embodiments disclosed represent a method for producing environmentally friendly fabric and textile products without use of chemicals. Referring now to the drawing, and more particularly to FIG. 1, a flowchart of steps of a preferred method for producing environmentally friendly fabric for use in making textile products is illustrated. Preferably, the method is performed using only water, water vapor (steam), and enzymes, so as to prevent use of chemicals including chemical agents. The method 100 includes the steps of: (a) singeing 101, (b) desizing 103, (c) washing 105, (d) peaching 107; (e) stentering 109; and (f) sanforizing 111.

The singeing step 101 comprises passing the fabric through a singeing machine in order to obtain a clean fabric surface. The step is usually carried out in a singeing machine by passing one or both sides of a fabric over a gas flame; however, it should be noted that the singeing can be done using a plate singeing machine and a rotary-cylinder singeing machine. The fabric is passed through a high temperature flame, which is preferably between about 800° C. to 100° C. The flame intensity is about 12 mm to 18 mm. The speed with which the fabric passes through the flame may vary from about 80 m/min to 100 m/min.

The desizing step 103 comprises enzyme desizing. Enzymatic desizing is a desizing process of degrading starch size on cotton fabrics using enzymes and is used to remove the size materials from the fabric. The enzymatic desizing preferably takes place in a desizing machine in which the enzymes are introduced at a temperature of about 65° C. to 80° C. in order to react with the fabric for about six to eight hours. The enzymes added for desizing preferably is Alpha amylase. During desizing, the temperature of the enzymatic reaction is maintained at about 60° C. to 80° C., and water hardness is maintained at about 4 ppm to 6 ppm.

The washing step 105 comprises washing the fabric from the desizing step with water. Preferably the fabric is washed using water having a temperature of about 85° C. to 95° C. The washing is carried out to remove the dissolved sizing material from the surface of the fabric, and is done to ensure that all sizing content from the fabric is removed.

The peaching step 107 comprises impacting the fabric with a plurality of bristles. Preferably the fabric after washing passes through a peaching machine, which includes a cylindrical rotating member having a plurality of ceramic crystal bristles that, preferably, are produced in a diamond shape. The fabric preferably is passed through the peaching machine at a speed of about 30 to 35 meters per minute. During this passing of the fabric through the peaching machine, the ceramic crystal bristles makes contact with the fabric surface and causes the fibers to protrude from the surface of the fabric to provide a smooth finish. The process of passing the fabric on the ceramic crystal bristles is referred to as "peaching".

The stentering step 109 comprises passing the fabric to a stenter machine, which is an open-width fabric-finishing machine in which the fabric is held by attachments to a pair of endless travelling chains such that the fabric is finished to a specified width. The attachments may be pins (pin stenter) or clips. The main purpose of stentering is to provide a uniform width throughout the length of the fabric. Further, the stentering is used for controlling the GSM (gram per square meter) of the fabric. The peached fabric preferably is passed through plain water and then treated with hot air having a temperature of about 80° C. to 130° C. to control the width shrinkage of the fabric.

The sanforizing step 111 comprises passing the fabric through a sanforizing machine. The fabric preferably is continually fed into the sanforizing machine and moistened with either water or steam having a temperature of about 50° C. to 60° C. A first rotating cylinder having a rubber sleeve is pressed against a second rotating cylinder. The second rotating cylinder is heated to a predetermined temperature. The sleeve initially gets compressed and then laterally expands. After expansion the sleeve returns to its normal thickness by relaxing. The fabric which is to be treated is passed between the rubber sleeve and the second heated cylinder. Thus, the sanforizing process reduces the length wise shrinkage of the fabric.

The foregoing ranges are believed to contain preferred values for the steps of the process, any particular optimum value for which can be determined through experiment once the variables specific to any particular implementation are known.

In view of the foregoing, the disclosed preferred processes and steps preferably use a purely physical finishing process without chemical treatment. Thus, it will be appreciated that the preferred steps are a green textile fabric finishing process that reduces pollution.

Based on the foregoing description, it will be readily understood by those persons skilled in the art that the present invention is susceptible of broad utility and application. Many embodiments and adaptations of the present invention other than those specifically described herein, as well as many variations, modifications, and equivalent arrangements, will be apparent from or reasonably suggested by the present invention and the foregoing descriptions thereof, without departing from the substance or scope of the present invention.

Accordingly, while the present invention has been described herein in detail in relation to one or more preferred embodiments, it is to be understood that this disclosure is only illustrative and exemplary of the present invention and is made merely for the purpose of providing a full and enabling disclosure of the invention. The foregoing disclosure is not intended to be construed to limit the present invention or otherwise exclude any such other embodiments, adaptations, variations, modifications or equivalent arrangements, the present invention being limited only by the claims appended hereto and the equivalents thereof.

What is claimed is:

1. A method for producing a fabric, comprising the steps of:

(a) singeing a continuous length of a fabric;

(b) after said step (a), desizing the continuous length of fabric;

(c) after said step (b), washing the continuous length of fabric;

(d) after said step (c), peaching the continuous length of fabric by impacting at least one of the surfaces of the fabric with a plurality of bristles;

(e) after said step (d), stentering the continuous length of fabric; and (f) after said step (e), sanforizing the continuous length of fabric;

(g) wherein said steps (a) through (f) are performed using only water, water vapor, and enzymes without use of chemicals.

2. The method of claim 1, wherein said step (a) is performed by passing the fabric on a singeing machine at a predetermined speed.

3. The method of claim 2, wherein the continuous length of fabric in the singing machine is subjected to a gas singe having a flame temperature about 800° C. to 1000° C. and operating at a speed of 80 meters per minute to 100 meters per minute.

4. The method of claim 1, wherein said step (b) is performed using a desizing machine.

5. The method of claim 1, wherein said step (b) comprises enzymatic desizing and the enzymatic desizing takes place in a desizing machine where the enzymes are introduced at a temperature of 60° C. to 80° C. to react with the continuous length of fabric for about six to eight hours.

6. The method of claim 1, wherein the continuous length of fabric is washed with water having a temperature of about 85° C. to 95° C. at a speed of about 50 to 60 meters per minute.

7. The method of claim 1, wherein the plurality of bristles comprises a plurality of ceramic crystals.

8. The method of claim 7, wherein the bristles are ceramic crystal bristles provided on a rotating cylinder which contacts at least one of the continuous length of fabric surfaces.

9. The method of claim 7, wherein the ceramic crystal bristles are diamond shaped.

10. The method of claim 1, wherein said step (e) is performed using a stenter machine.

11. The method of claim 10, wherein the stenter machine facilitates controlling width of the continuous length of fabric throughout its length.

12. The method of claim 1, wherein said step (f) is performed using a sanforizing machine.

13. The method of claim 12, wherein the continuous length of fabric is passed between a rubber sleeve and a heated rotating cylinder having a temperature of about 50° C. to 60° C.

14. A method for producing a fabric, comprising the steps of:

(a) singeing a continuous length of a fabric by passing the fabric on a singeing machine at a predetermined speed, wherein the continuous length of fabric in the singing machine is subjected to a gas singe having a flame temperature about 800° C. to 1000° C. and operating at a speed of 80 meters per minute to 100 meters per minute;

(b) after said step (a), enzymatic desizing the continuous length of fabric, wherein the enzymatic desizing takes place in a desizing machine in which enzymes are introduced at a temperature of 60° C. to 80° C. to react with the continuous length of fabric for about six to eight hours;

(c) after said step (b), washing the continuous length of fabric with water having a temperature of about 85° C. to 95° C. at a speed of about 50 to 60 meters per minute;

(d) after said step (c), peaching the continuous length of fabric by impacting at least one of the surfaces of the fabric with a plurality of diamond shaped ceramic crystals provided on a rotating cylinder which contacts at least one of the continuous length of fabric surfaces;

(e) after said step (d), stentering the continuous length of fabric using a stenter machine such that a generally uniform width of the continuous length of fabric is provided; and (f) after said step (e), sanforizing the continuous length of fabric using a sanforizing machine, wherein the continuous length of fabric is passed between a rubber sleeve and a heated rotating cylinder having a temperature of about 50° C. to 60° C.;

(g) wherein said steps (a) through (f) are performed using only water, water vapor, and enzymes without use of chemicals.

15. A method for producing a fabric, comprising the steps of:

(a) passing a continuous length of a fabric of a predetermined width on a singeing machine at a predetermined speed;

(b) subjecting the fabric treated with the singeing machine to an enzymatic desizing;

(c) washing the fabric obtained from the enzymatic desizing;

(d) impacting at least one of the surfaces of the fabric with a plurality of bristles;

(e) passing the fabric treated by the bristles to a stenter machine; and (f) transferring the fabric obtained from the stenter machine to a sanforizing machine;

(g) wherein the steps are performed without use of chemicals.

16. The method of claim 15, wherein the fabric in the singing machine is subjected to a gas singe having a flame temperature about 800° C. to 1000° C. and operating at a speed of 80 meters per minute to 100 meters per minute.

17. The method of claim 15, wherein the enzymatic desizing takes place in a desizing machine where enzymes are introduced at a temperature of 60° C. to 80° C. to react with the fabric for about six to eight hours.

18. The method of claim 15, wherein the fabric is washed with water having a temperature of about 85° C. to 95° C. at a speed of about 50 meters per minute to 60 meters per minute.

19. The method of claim 15, wherein the bristles are ceramic crystal bristles provided on a rotating cylinder which contacts at least one of the fabric surfaces.

20. The method of claim 15, wherein the fabric is passed between a rubber sleeve and a heated rotating cylinder having a temperature of about 50° C. to 60° C.

* * * * *